United States Patent [19]

Rockom et al.

[11] Patent Number: 4,889,252

[45] Date of Patent: Dec. 26, 1989

[54] INSULATED CONTAINER

[75] Inventors: John W. Rockom, Seattle; Charles A. Collier, Bellevue, both of Wash.

[73] Assignee: Allpak Container, Inc., Tukwila, Wash.

[21] Appl. No.: 273,272

[22] Filed: Nov. 18, 1988

[51] Int. Cl.[4] ..... B65D 5/56

[52] U.S. Cl. ..... 220/3.1; 220/418

[58] Field of Search ..... 220/3.1, 403, 418, 443, 220/416, 426; 206/522, 523

[56] References Cited

U.S. PATENT DOCUMENTS

| | | | |
|---|---|---|---|
| 3,144,979 | 8/1964 | Young | 220/443 |
| 3,349,990 | 10/1967 | Woodford | 220/418 |
| 4,093,068 | 6/1978 | Smrt | 206/522 |
| 4,287,250 | 9/1981 | Rudy | 206/522 |
| 4,551,379 | 11/1985 | Kerr | 206/522 |
| 4,700,862 | 10/1987 | Carter et al. | 220/443 |
| 4,762,231 | 8/1988 | Kiselewski | 206/522 |
| 4,773,534 | 9/1988 | De Haras et al. | 206/522 |
| 4,801,213 | 1/1989 | Frey et al. | 206/522 |

FOREIGN PATENT DOCUMENTS

| | | | |
|---|---|---|---|
| 2391121 | 1/1979 | France | 206/522 |
| 2415943 | 9/1979 | France | 206/522 |

*Primary Examiner*—Jimmy G. Foster

*Attorney, Agent, or Firm*—Christensen, O'Connor, Johnson & Kindness

[57] ABSTRACT

An insulated container (10) formed of corrugated paperboard (12) having sidewalls (14), top flaps (16) and bottom flaps (18). An insulator (32), comprised of a layer of flexible material having air bubbles (46) entrapped therein and laminated between layers of reflective foil (40), is bonded to the corrugated paperboard (12) with adhesive (38) to achieve thermal insulation and shock absorbent packaging.

2 Claims, 1 Drawing Sheet

INSULATED CONTAINER

TECHNICAL FIELD OF THE INVENTION

The present invention pertains to containers and, more particularly, to an insulated paperboard container adapted to ship material requiring thermal protection and cushioned packaging.

BACKGROUND OF THE INVENTION

Paperboard containers are used to ship and store items in all types of environmental conditions. These containers are typically formed from a single layer of corrugated paperboard sandwiched between a pair of flat paperboard sheets. While this construction results in a light and rigid structure, it provides little thermal insulation and cushioning. As a result, the contents stored therein will have little protection from heat and cold as well as from rough handling. More importantly, items that must remain at elevated or lowered temperatures will quickly experience adverse temperature changes.

One method for providing insulation in corrugated containers is to use molded expanded polystyrene (EPS) blocks or containers inserted into a corrugated box as a packing material. This type of material, however, has several drawbacks. Although EPS is rigid and lightweight, it is brittle and tends to fracture with handling and use. It is also bulky and space consuming. In addition, the chlorofluorocarbons used in EPS are known to have a depleting effect on the stratospheric ozone and will not meet new government standards as to its effect on the environment.

SUMMARY OF THE INVENTION

The present invention is directed to an insulated container that is formed to have one or more walls that define an interior surface. Insulation, comprised of flexible material having bubbles of air entrapped therein to provide thermal insulation and shock absorbent packaging is bonded to the interior surface of the one or more walls.

In accordance with another aspect of the present invention, the container comprises at least one sidewall, a bottom, and a top, each having an inside surface to which is attached an insulator comprising at least one layer of flexible material having at least one layer of air bubbles entrapped therein to provide thermal insulation and shock absorbent packaging. The layer of flexible material has bonded to each side thereof a layer of reflective foil.

As will be appreciated from the foregoing description, the present invention provides an insulated corrugated container that maintains frozen and deep-cooled items at a low temperature or vice versa, and gives greater protection against radiant heat sources. In addition, the insulated container will meet new government environmental standards because it contains no chlorofluorocarbons. Furthermore, the layer of insulation is food grade approved, thus permitting a wider use of the insulated container.

BRIEF DESCRIPTION OF THE DRAWINGS

The features and advantages of the present invention will become more readily appreciated as the same becomes better understood by reference to the following detailed description when taken in conjunction with the accompanying drawings wherein.

DETAILED DESCRIPTION OF THE PREFERRED EMBODIMENT

Figure 1:
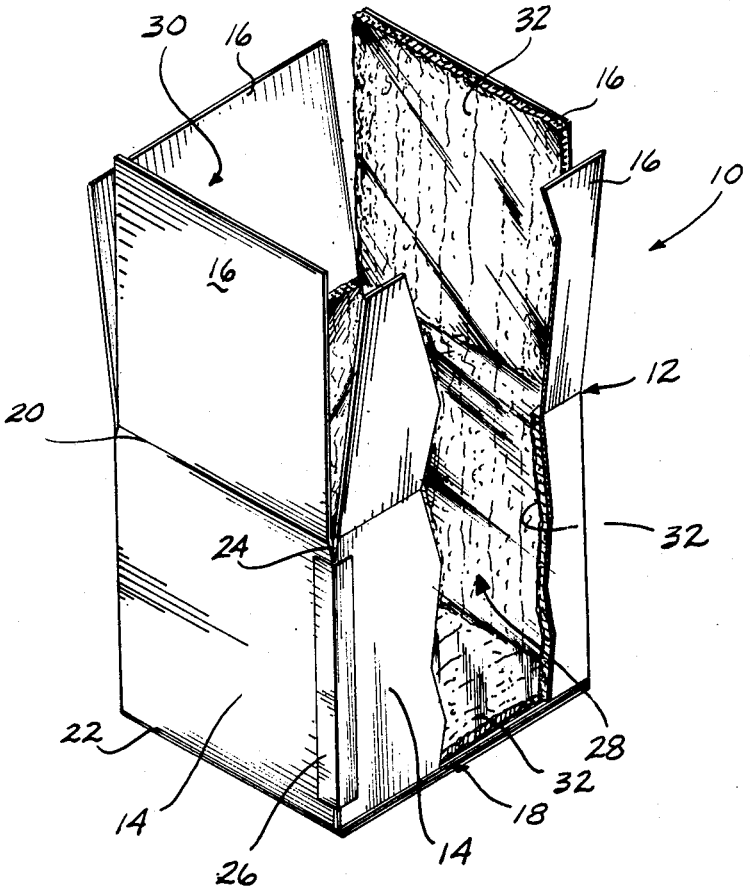
FIG. 1 is an isometric view in partial cut-away of an insulated container formed in accordance with the present invention; and, FIG. 2 is a cross-sectional view of an insulated paperboard panel taken from the insulated container of FIG. 1.

Referring initially to FIG. 1, the representative embodiment of the insulated container 10 is shown formed from a single sheet of corrugated cardboard 12 having sidewalls 14 top flaps 16 and bottom flaps 18. The flaps 16 and 18 are scored to form top and bottom fold lines 20 and 22, respectively. The sidewalls 14 are brought together at a seam 24 and held in place by reinforced tape 26. The resultant container 10 has an interior 28 bounded by the inside surface 30 of the cardboard 12.

A lining in the form of a cushioned insulator 32 lines the inside surface 30 of the sidewalls 14. In configurations where the four top flaps 16, when folded over, extend halfway across the interior 28 such that opposing flaps are in abutting relationship one pair of opposing top flaps 16 will be lined with the insulator 32. In configurations where one top flap 16 will cover the entire opening to the interior 28, as illustrated in FIG. 1, then only that one flap need be lined with the insulator 32. The foregoing applies as well to the bottom flaps 18.

Figure 2:
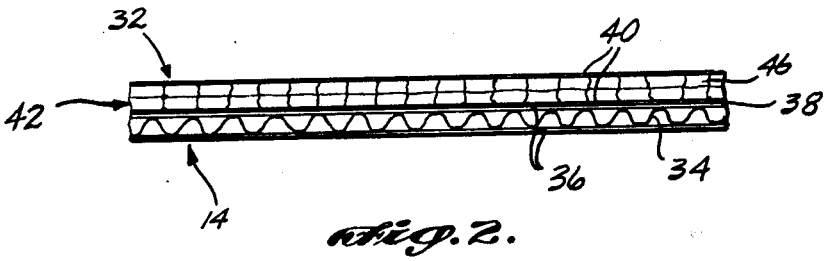

FIG. 2 is a cross-sectional illustration of a sidewall 14 having one layer of corrugated paperboard 34 bounded on both sides by flat sheets of paperboard 36. The cushioned insulator 32 is bonded to one of the paperboard sheets 36 by any suitable adhesive 38. The cushioned insulator 32 consists of two sheets of reflective foil 40 laminated to the outsides of two layers of air-bubble cushioning 42. The reflective foil 40 may be constructed of aluminum or other reflective material. The air-bubble cushioning 42 is preferably constructed of flexible heavy-duty polyethylene. The insulator of the type described above is available from Astro-Packaging located in Wenatchee, Wash., under the trademarked name Astro-Foil.

When the insulated container 10 is closed, the top and bottom flaps 16 and 18 having the insulator 32 on the inside surface 30 thereof will be folded over first, followed by the remaining flaps, which are then held in place by a suitable adhesive or tape. Once the container 10 is so closed, the air bubbles 46 in the insulator 32 form a dead air space between the reflective foil surfaces 40, providing insulation against radiant heat, as well as a cushioning effect. As will be readily appreciated from the foregoing description, the present invention provides an insulated container that resists drops, forklift strikes, and maintains frozen and deep-cooled items at a low temperature or vice versa.

While a preferred of the embodiment of the invention has been illustrated and described, it will be appreciated that various changes may be made therein without departing from the spirit and scope of the invention as recited in the appended claims. For instance, the corrugated paperboard may be replaced with folding cotton stock, plastic corrugated material, wood, metal, or plastic sheeting. Consequently, the invention may be practiced otherwise than as described herein.

The embodiments of the invention in which an exclusive property or privilege is claimed are defined as follows:

1. An insulated container, comprising one or more walls having an interior surface, and an insulation means bonded to the interior surface of the one or more walls, the insulation means including at least one layer of flexible material having bubbles of air entrapped therein to provide a soft cushion and thermal insulation and further wherein the layer of flexible material is sandwiched between one or more layers of reflective foil.

2. An insulated container, comprising:

a plurality of side panels, each of the side panels having an interior surface and an exterior surface;

at least one top panel interconnected with one or more of the side panels, each of the at least one top panel having an interior surface and an exterior surface;

at least one bottom panel interconnected with one or more of the side panels, each of the at least one bottom panel having an interior surface and an exterior surface; and means for providing thermal insulation, the insulation means being formed of flexible material having at least one layer of air bubbles entrapped therein, the insulation means being bonded to the inside surface of the plurality of side panels and the inside surface of the at least one top panel and to the inside surface of the at least one bottom panel and further wherein the insulation means comprises a layer of reflective foil bonded to each side of the layer of flexible material.

* * * * *